US007300318B2

(12) United States Patent
Deja et al.

(10) Patent No.: US 7,300,318 B2
(45) Date of Patent: Nov. 27, 2007

(54) SECURING ELEMENT FOR PREVENTING THE RELEASE OF A PLUG CONNECTION BETWEEN A CABLE HARNESS PLUG AND A COUPLER PLUG

(75) Inventors: Leokadia Deja, Freiberg (DE); Wolfgang Pade, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/548,978

(22) PCT Filed: Sep. 17, 2003

(86) PCT No.: PCT/DE03/03083

§ 371 (c)(1),
(2), (4) Date: Jul. 19, 2006

(87) PCT Pub. No.: WO2004/082079

PCT Pub. Date: Sep. 23, 2004

(65) Prior Publication Data

US 2007/0149026 A1 Jun. 28, 2007

(30) Foreign Application Priority Data

Mar. 10, 2003 (DE) ..... 103 10 295

(51) Int. Cl.
*H01R 13/502* (2006.01)

(52) U.S. Cl. ..... 439/695; 439/596

(58) Field of Classification Search ..... 439/352, 439/358, 596, 598, 617, 618, 695, 701
See application file for complete search history.

(56) References Cited

U.S. PATENT DOCUMENTS

| | | | | |
|---|---|---|---|---|
| 4,438,995 | A | 3/1984 | Cristell et al. | |
| 5,338,211 | A | 8/1994 | Kodama et al. | |
| 5,518,425 | A * | 5/1996 | Tsai | 439/660 |
| 6,217,388 | B1 * | 4/2001 | Francis | 439/620.07 |
| 6,780,042 | B1 * | 8/2004 | Badescu et al. | 439/352 |
| 7,131,854 | B1 * | 11/2006 | Pavlovic et al. | 439/352 |

* cited by examiner

*Primary Examiner*—Thanh-Tam Le
(74) *Attorney, Agent, or Firm*—Kenyon & Kenyon LLP

(57) ABSTRACT

A securing element for protecting against an unintentional release of a plug connection between a cable harness plug and a coupler plug. The securing element is distinguished in that it may easily be mounted on the side of a cable harness plug facing away in the plug-in direction, and, once the securing element has assumed the final position, it additionally causes a region of the locking element provided on the cable harness plug to be blocked. In an advantageous further development, securing element also has a grooved-tube retainer which is integrally joined to the securing element.

7 Claims, 2 Drawing Sheets

SECURING ELEMENT FOR PREVENTING THE RELEASE OF A PLUG CONNECTION BETWEEN A CABLE HARNESS PLUG AND A COUPLER PLUG

FIELD OF THE INVENTION

The present invention relates to a securing element for preventing an unintentional release of a plug connection between a cable harness plug and a coupler plug.

BACKGROUND INFORMATION

Especially plug connections with a low number of pins, but also coupler plugs in the form of a lambda probe must be coupled via a coupler plug. To ensure that, first of all, the plug connection is implemented correctly, a variety of securing elements are already known. Secondly, securing elements that ensure that an entire plug connection, once it has been established, cannot be released easily, are also known from the related art. The latter may be subdivided into safety mechanisms that must first be destroyed to reverse the plug connection and those in which the securing element must actively be removed so as to likewise release a plug connection.

SUMMARY OF THE INVENTION

It is an objective of the present invention to produce a securing element that is releasable and which may be mounted on a segment of a plug connection in a simple manner, and which may later also be removed again without destroying it.

According to the present invention, a securing element is attachable to a cable harness on the side facing away from a coupler plug and may be plugged in an uncomplicated manner.

To this end, a design that has a virtually ring-shaped form is provided for this security element, the security element including a hinge, situated on its periphery, and a locking element which—in a position prior to installation—is able to be mounted on the end of the cable-harness plug facing away in the plug-in direction to the coupler plug, from where it is able to be brought into a final position, the securing element having a mushroom-type form which points away from the periphery and cooperates with a locking element of the cable-harness plug.

One advantage of the present invention is that an additional securing element for protecting a plug-in connection against an unintended release has been created in a very simple manner. The securing element advantageously has a ring-shaped form that is able to be clipped onto the cable harness plug.

The preferred embodiment has two hinges, parts or segments of the ring-shaped form being able to be rotated about the hinge axis. This makes it very easy to plug it into the one end of the cable harness plug. To mount the securing element on the cable harness, the outwardly pointing sections are brought together and the individual free ends of the segments have a locking element, preferably catching elements, which then tightly press the entire securing element against the periphery of the coupler plug.

In addition, the securing element has a mushroom-type form which is located on the outer periphery of the ring-shaped securing element. This design extends exclusively across a segment portion of the ring-shaped form. The ring-shaped form brings about with a locking element that is likewise situated on the cable harness. This locking element is provided to safeguard the established plug connection to the coupler plug. As a rule, this plug connection may be released very easily by downward pressure on the locking element. However, due to this mushroom-type design, it is impossible to press the locking element down, so that—once the plug connection has been established—it may be released exclusively by removing the ring-shaped securing element and subsequently actuating the locking element on the cable harness. Since the securing element itself has a locking mechanism, there is no need to destroy the securing element for removal purposes, and the securing element may continue to be used.

Another advantage of the securing element is that it also has so-called grooved-tube holder on its outer wall. This grooved tube is used to protect the lines leading to the cable harness in an appropriate manner.

The grooved-tube holder has bulges on its periphery, so that the grooved tube may be retained accordingly by way of a press and/or form connection.

The grooved-tube holder and securing element are preferably designed as one piece. Due to the one-piece construction the securing element may already be positioned in a grooved tube, so that a very simple assembly together with the grooved tube and the securing element is possible on a cable harness.

DETAILED DESCRIPTION

Figure 1:
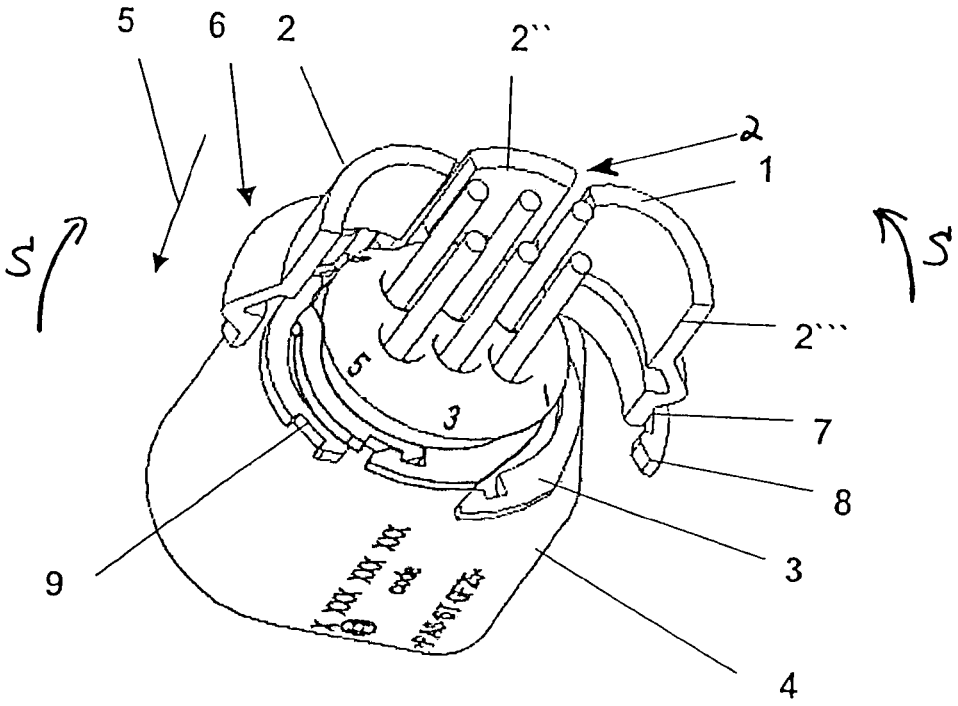
FIG. 1 shows a perspective view of the cable harness plug having the securing element according to the present invention, in a position prior to installation.
Figure 2:
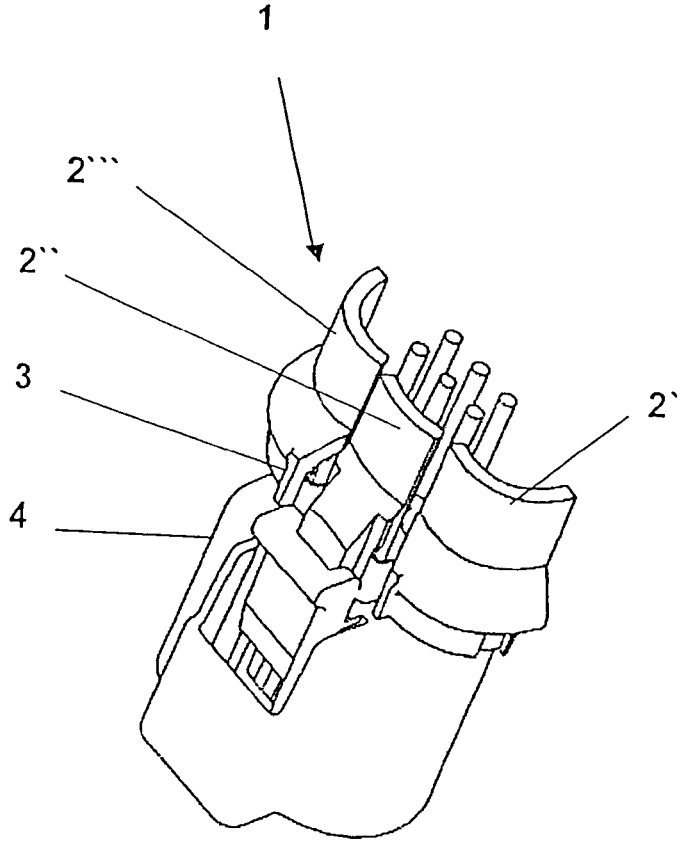
FIG. 2 shows another perspective view of the cable harness plug having the securing element according to the present invention, in a position prior to installation.

FIGS. 1 and 2 show a perspective view of a securing element 1 according to the present invention in a position prior to installation. Securing element 1 includes a ring-shaped body 2 having three segments, 2', 2" and 2'", center segment 2" being mounted directly on base element 3 of cable harness plug 4 shown here in a manner not shown in greater detail in FIGS. 1 and 2.

To reach the final position shown in FIG. 1, segment parts 2' and 2'" pivot in the direction of pivoting arrows S according to FIG. 1 until reaching the position illustrated here. In addition, ends 6 of segments 2' and 2'" have a locking element 7. Here, in the exemplary embodiment shown in FIG. 1, this locking element is made up of a detent 8 which engages with a recess 9 in the locked state of securing element 1.

Figure 3:
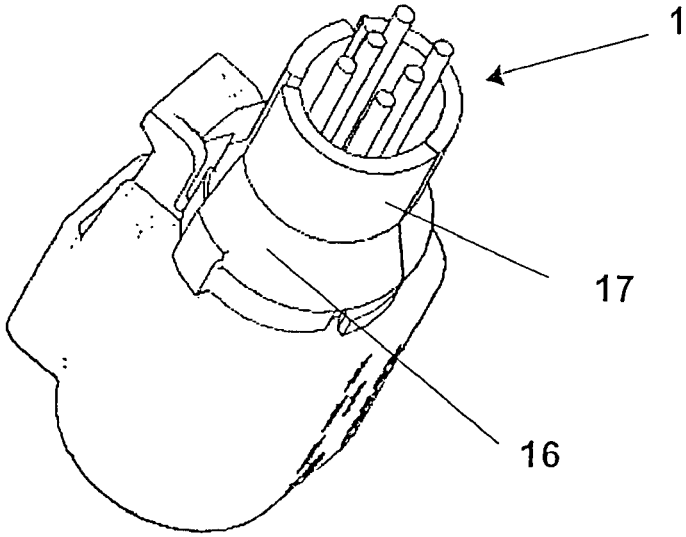
FIG. 3 shows a section through a plug connection of a cable harness plug having the coupler plug and the securing element according to the present invention.
Figure 4:
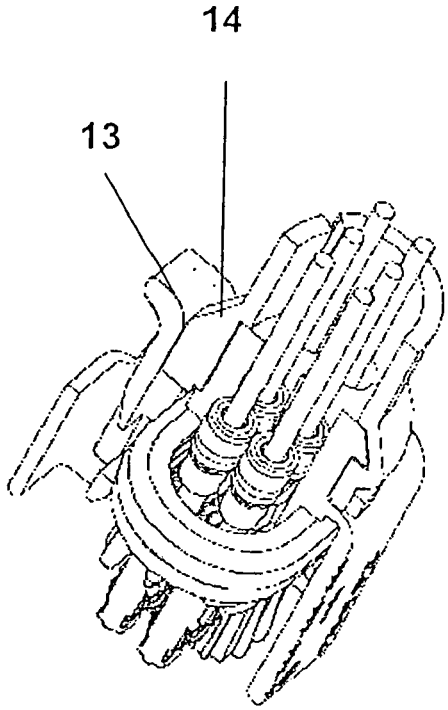
FIG. 4 shows a section through the cable harness with a depiction of the securing element according to the present invention.
Figure 5:
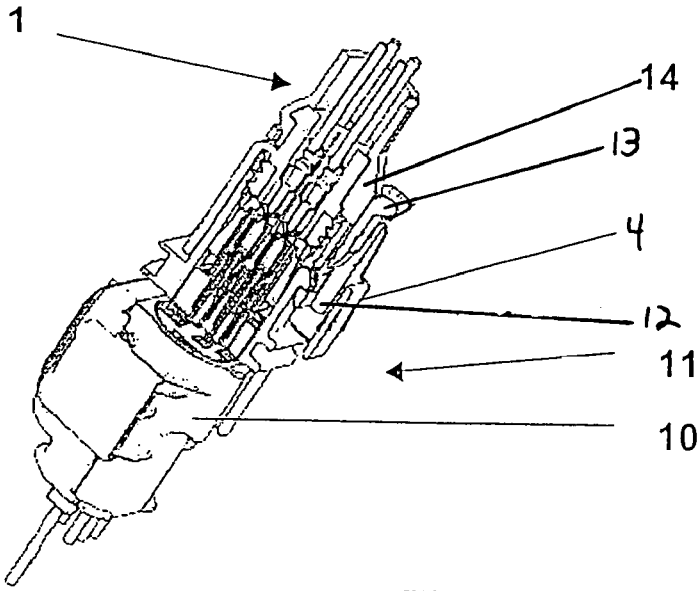
FIG. 5 shows a perspective view of the cable harness plug having the securing element according to the present invention.

FIGS. 3 through 5 show securing element 1 illustrated in FIGS. 1 and 2 in the latched position.

In particular in FIG. 5, both cable harness plug 4 and a coupler plug 10 are provided, both having entered into a plug-in connection 11. Cable harness plug 4 in addition has on its outer side a locking element 12 in the form of a locking hook 13. Plug-in connection 11 shown here is configured in such a way that the cable harness plug and coupler plug 10 may be separated from one another only by activating locking hook 13.

However, because of the introduction of securing element 1, it is impossible to press locking hook 13 down and thus release plug-in connection 11 since securing element 1 has a mushroom-type form 14 on its segment 2" that extends into the region of locking hook 13 and prevents locking hook 13 from being pressed down.

This mushroom-type form 14 and the blocking of locking hook 13 are also shown in an enlarged FIG. 4.

On outer wall 16 of securing element 1 is a so-called grooved-tube holder 17 (not shown further in the drawings).

The outer diameter of this grooved-tube holder 17 is dimensioned such that it is able to penetrate a grooved tube, thereby producing a form-locking connection between the grooved tube and grooved-tube holder 17.

The design of the securing element according to the present invention makes it very easy to produce a securing element by which a plug-in connection 11 may be secured. In addition, securing element 1 includes technical designs that have a very positive effect on handling and installation.

What is claimed is:

1. A securing element for preventing a release of a plug-in connection, the plug-in connection connecting a cable harness plug and a coupler plug, comprising:

a body having a mushroom-type portion and having a virtually ring-shaped portion;

at least one hinge; and a first locking element, wherein:

the at least one hinge and the first locking element are disposed on a periphery of the ring-shaped portion, in a position prior to installation, the body is able to be mounted on an end of the cable harness plug facing away in a plug-in direction to the coupler plug, from where the body is able to be brought into a final position, and the mushroom-type portion points away from the periphery of the ring-shaped body and is configured to cooperate with a second locking element of the cable harness plug when the cable harness plug is connected to the coupler plug.

2. The securing element as recited in claim 1, wherein the at least one hinge includes a plurality of hinges that includes film hinges.

3. The securing element as recited in claim 1, wherein the at least one hinge includes two hinges.

4. The securing element as recited in claim 1, wherein the first locking element includes a detent that engages in a recess.

5. The securing element as recited in claim 1, further comprising:

a grooved-tube holder arranged on the body.

6. The securing element as recited in claim 5, wherein the grooved-tube holder and the body form one piece.

7. The securing element as recited in claim 1, wherein:

a segment of the mushroom-type portion on a periphery thereof assumes and blocks the second locking element to prevent an opening of the plug-in connection between the cable harness plug and the coupler plug.

* * * * *